US005340176A

United States Patent [19]

Cresci

[11] Patent Number: 5,340,176

[45] Date of Patent: Aug. 23, 1994

[54] WINDOW WEDGE

[76] Inventor: Randolph J. Cresci, 66 Hilliard Ave., Central Islip, N.Y. 11722-2216

[21] Appl. No.: 72,446

[22] Filed: Jun. 7, 1993

[51] Int. Cl.[5] ..... E05C 17/54

[52] U.S. Cl. ..... 292/343; 292/DIG. 47

[58] Field of Search ..... 292/288, 342, 343, 244, 292/DIG. 46, DIG. 47, DIG. 7

[56] References Cited

U.S. PATENT DOCUMENTS

| | | | |
|---|---|---|---|
| 1,648,371 | 11/1927 | Thompson | 292/DIG. 7 X |
| 2,425,937 | 8/1947 | Hilton | 292/342 |
| 2,568,477 | 9/1951 | Westlund | 292/343 X |
| 3,328,065 | 6/1967 | Arenson | 292/343 |
| 4,208,841 | 6/1980 | Starks | 292/343 X |
| 4,579,377 | 4/1986 | Dallaire et al. | 292/343 |

*Primary Examiner*—Rodney M. Lindsey

[57] ABSTRACT

A window wedge is used as a stop for a sliding type window such as a double hung window. The wedge has a strip of hook and loop material (VELCRO)( TM ) on its base. A second strip of mating hook and loop material can be affixed to the stile of one window. The wedge can than be attached to the stile at any point along the second strip of hook and loop material such that the other window can only open to the point where it is stopped by the wedge. The wedge can be quickly and easily moved to a different point along the strip on the stile, changing the amount the window can be opened.

2 Claims, 5 Drawing Sheets

WINDOW WEDGE

BACKGROUND OF THE INVENTION

1. Field of the Invention

The present invention relates generally to windows, and more particularly, to a wedge for a window especially adapted to limit the amount a window can be opened.

2. Description of the Prior Art

Stops in the form of a wedges and the like are well known in the prior art for holding doors and sliding windows closed (see for example U.S. Pat. Nos. 4,736,974 and 4,958,869). Other stops are shown in U.S. Pat. Nos. 3,977,714; 4,423,897; and 4,624,085. Wedge shaped blocks of wood and the like have been used for years to keep doors open and closed. Unfortunately, the prior art stops tend to either be limited to one or two fixed stop positions or have unlimited stop positions but tend to slide against the force of the object being stopped.

Thus, while the foregoing body of prior art indicates it to be well known to use wedge shaped stops, the provision of a simple and cost effective device like that of the present invention is not contemplated. Nor does the prior art described above teach or suggest a window wedge device which may be used by individuals to hold a window open at an infinite number of alternate positions without the possibility of the wedge sliding. The foregoing disadvantages are overcome by the unique window wedge of the present invention as will be made apparent from the following description thereof. Other advantages of the present invention over the prior art also will be rendered evident.

SUMMARY OF THE INVENTION

To achieve the foregoing and other advantages, the present invention, briefly described, provides a window wedge which can be used as a stop for a sliding type window such as a double hung window. The wedge has a strip of hook and loop material on its base. A second strip of mating hook and loop material can be affixed to the stile of one window. The wedge can than be attached to the stile at any point along the second strip of hook and loop material such that the other window can only open to the point where it is stopped by the wedge. The wedge can be quickly and easily moved to a different point along the strip which changes the amount the window can open.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will form the subject matter of the claims appended hereto.

In this respect, before explaining the preferred embodiments of the invention in detail, it is to be understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which this disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms of phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new window wedge which has all of the advantages of the prior art and none of the disadvantages.

It is another object of the present invention to provide a new window wedge which may be easily and efficiently manufactured and marketed.

It is a further objective of the present invention to provide a new window wedge which is of durable and reliable construction.

An even further object of the present invention is to provide a new window wedge which is susceptible of a low cost of manufacture with regard to both materials and labor, and which accordingly is then susceptible of low prices of sale to the consuming public, thereby making such window wedge available to the buying public.

Still yet a further object of the present invention is to provide a new window wedge having a hook and loop strip (VELCRO) (TM) on its base allowing the wedge to be attached to a second hook and loop strip fixed on the stile of a sliding window such that the wedge acts as a stop to limit the amount the window can be opened.

It is still a further object of the present invention to provide a new window wedge having a slot in its base where the strip of hook and loop material is located.

Still a further object of the present invention is to provide a new window wedge which can be quickly and easily removed from one point on a window and quickly and easily positioned at a different point on the window, changing the amount the window can be opened before being stopped by the wedge.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawings wherein.

DESCRIPTION OF THE PREFERRED EMBODIMENT

Figure 1:
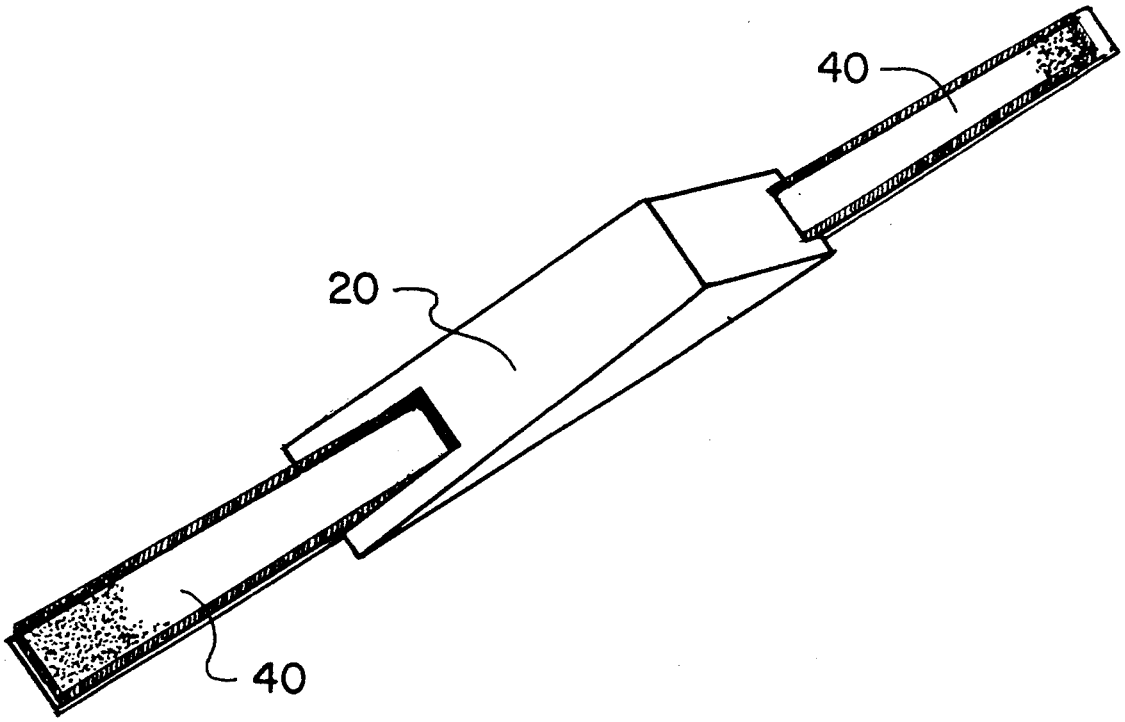
FIG. 1 is a perspective view showing the first preferred embodiment of the window wedge of the present invention fixed to a strip of hook and loop material all in accordance with the present invention.
Figure 2:
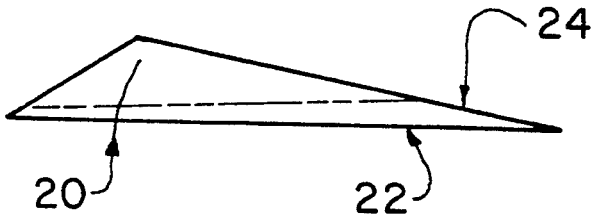
FIG. 2 is a side view of the window wedge of FIG. 1 in accordance with the present invention.
Figure 3:
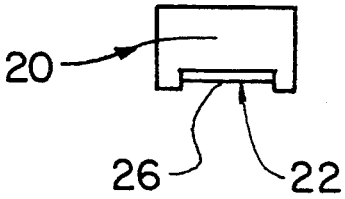
FIG. 3 is an end view of the window wedge of FIGS. 1 and 2 in accordance with the present invention.
Figure 4:
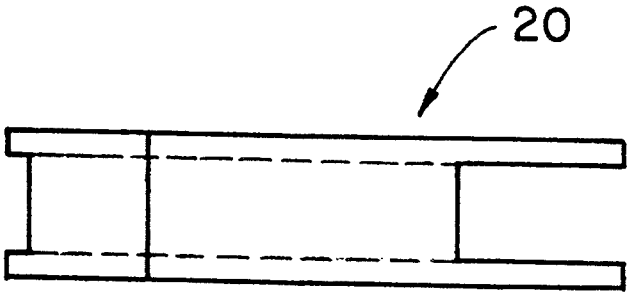
FIG. 4 is a top view of the window wedge of FIGS. 1–3 in accordance with the present invention.
Figure 5:
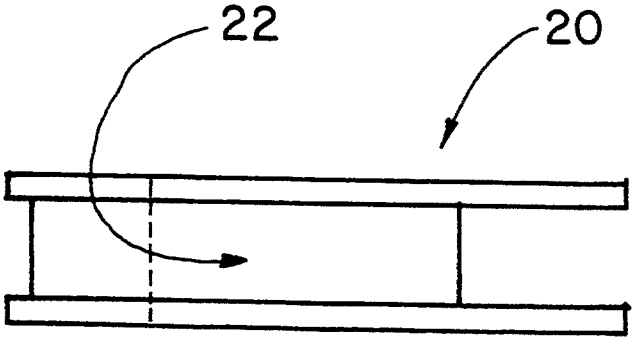
FIG. 5 is a bottom view in elevation of the window wedge of FIGS. 1–4 in accordance with the present invention.

With reference now to the drawings, a new and improved window wedge embodying the principles and concepts of the present invention will be described.

Turning initially to FIGS. 1–7, there is shown a first exemplary embodiment of the window wedge of the present invention generally designated by reference numeral 20. In its preferred form, window wedge 20 comprises generally a wedge shaped block having a rectangular base 22 except for a slot 26 running along the center of the base 22 from the back of the wedge 20 to the front. The wedge 20 is preferably made of a plastic material although any suitable material such as wood or rubber could be used and should be considered within the scope of the invention. In its preferred form the wedge 20 measures approximately three and a quarter inches long and approximately three quarters of an inch wide. The small angle side 24 of the wedge 20 is preferably angled at approximately ten degrees. The side 24 preferably extends to a point approximately three quarters of an inch from the opposite end of the wedge.

A groove or slot 26 is preferably cut in the wedge 20. A strip of hook and loop material such as VELCRO (TM) is fixed within the slot 26.

A second strip of hook and loop material such as that represented by reference numeral 40 in FIG. 1 can be fixed to the stile of a sliding window by means of a suitable adhesive. The second strip of material 40 fixed to the stile of a window is preferably substantially longer than the first strip in the slot 26 of the wedge 20.

Figure 6:
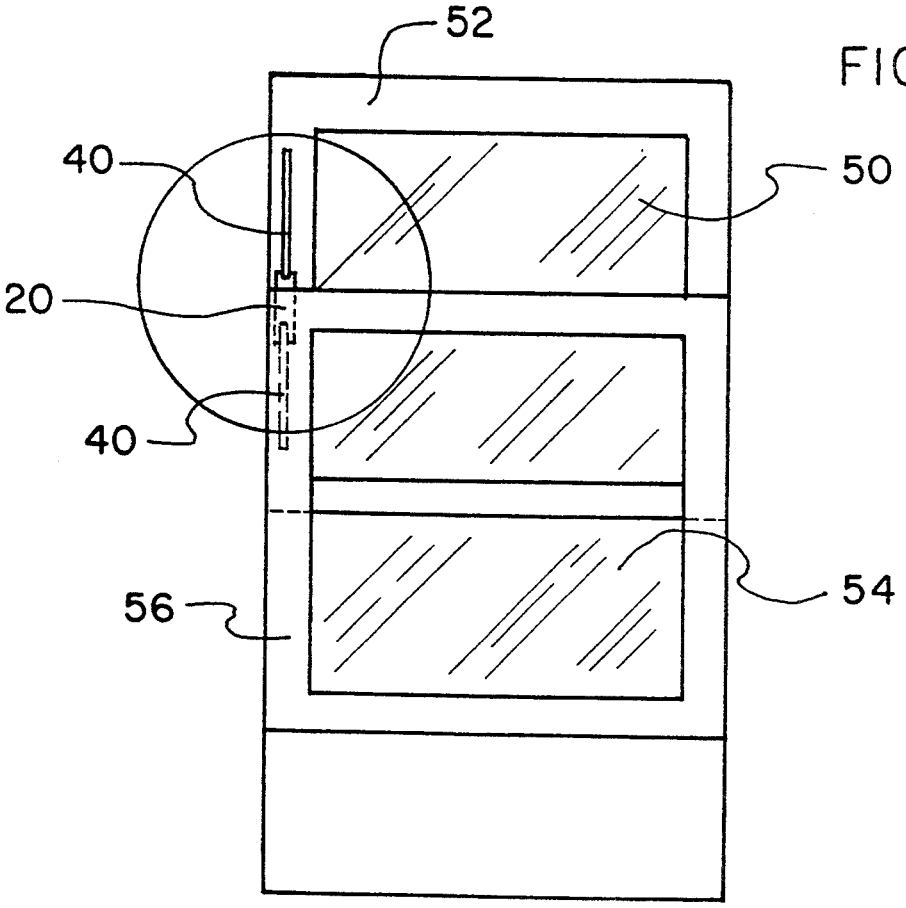
FIG. 6 is a perspective view showing the window wedge of FIGS. 1–5 in use on a double hung type of window in accordance with the present invention.
Figure 7:
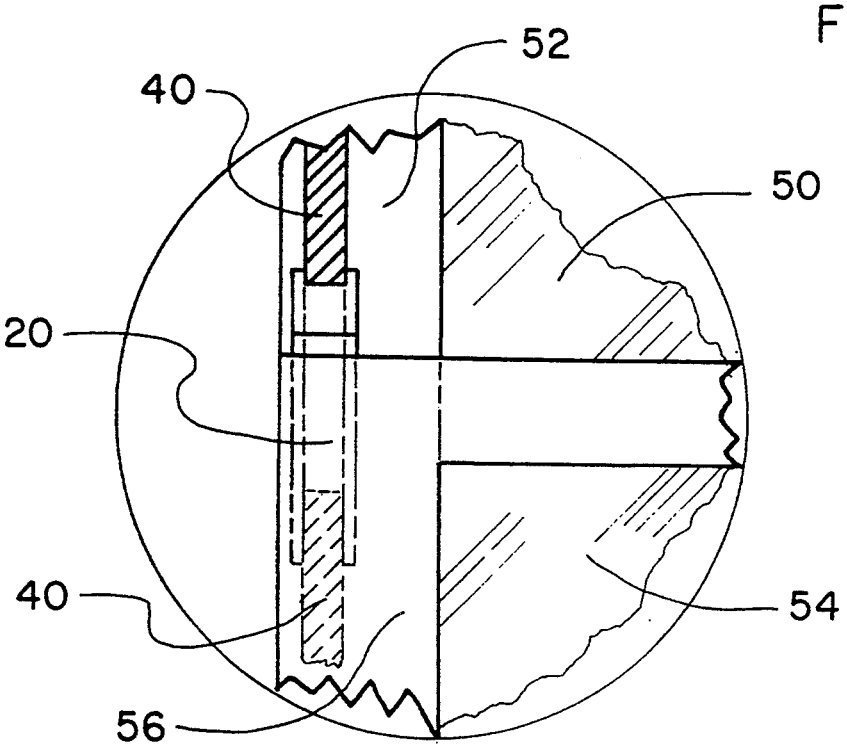
FIG. 7 is an enlargement of circle 7 in FIG. 6 showing the window wedge in use on a double hung type window in more detail all in accordance with the present invention.

The window wedge 20 of the present invention is easy to use. Referring particularly to FIGS. 6 and 7 which shows the wedge of the present invention used on a vertically sliding double hung type window, the second strip of hook and loop material 40 is fixed to the stile/frame 52 of the upper window 50. The wedge 20 is then "stuck" at a desired point on the strip 40 by means of the mating hook and loop strips. The slot 26 rides over the second strip 40 making it easier for the two strips to attach. The point at which the wedge is "stuck" is approximately the point at which the lower window 54 is prevented from being opened past. The frame 56 of the lower window 54 wedges against the wedge 20 preventing any further raising of the window when an attempt is made to slide the window 54 is made.

The wedge 20 of the present invention can be quickly and easily detached frown the hook and loop strip 40 and replaced at a different point on the hook and loop strip 40 effectively changing the amount the window can be opened.

Figure 11:
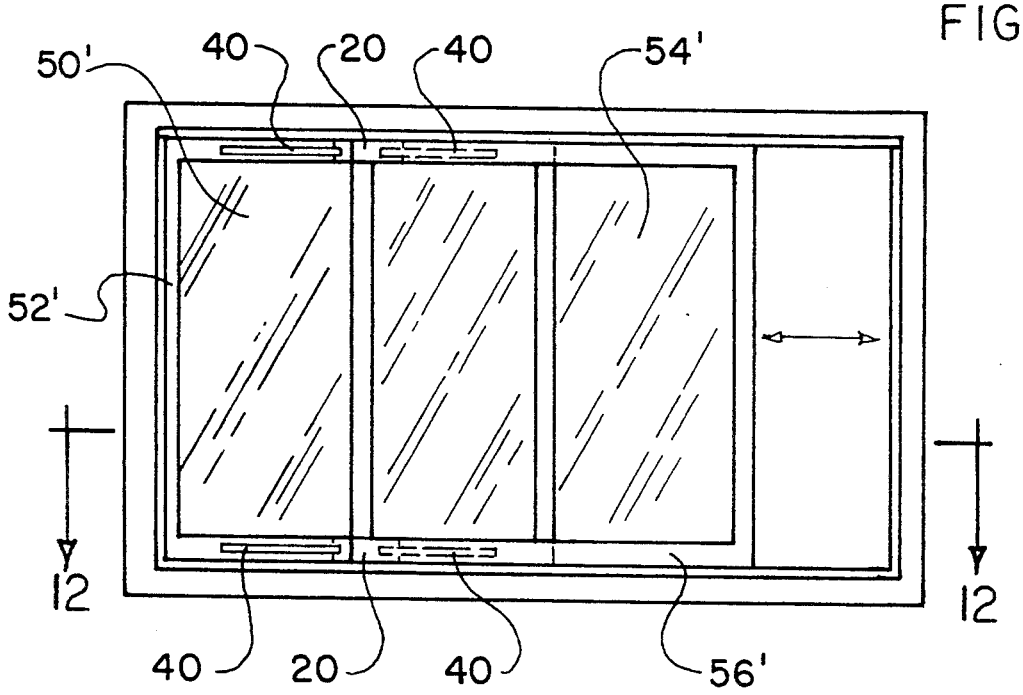
FIG. 11 is a perspective side view of a window wedge used on a horizontally sliding double window in accordance with the present invention.
Figure 12:
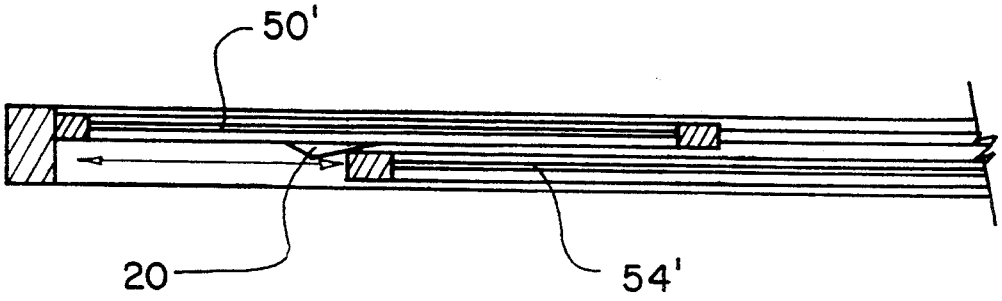
FIG. 12 is a cross-sectional view in elevation of the of the invention taken along 12—12 of FIG. 11.

The wedge 20 of the present invention can also be used for horizontally sliding double windows like those shown in FIGS. 11 and 12. A pair of wedges 20 are shown used to limit the amount right window 54' can be opened over left window 50'. A strip of hook and lop material 40 is place on the top and on the bottom of the window stile 52' of window 50'. The two wedges 20 can be attached to the strip 40 by means of the mating hook and loop material within their respective slots 26. As the right window 54' is slid open, the stile 56' becomes wedged against the wedges 20 limiting the amount the window 54' can move.

Figure 8:
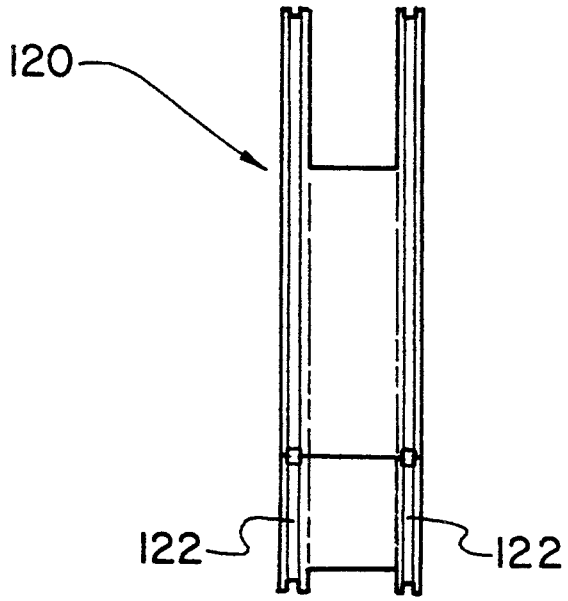
FIG. 8 is a top view of an alternative preferred embodiment of a window wedge in accordance with the present invention.
Figure 9:
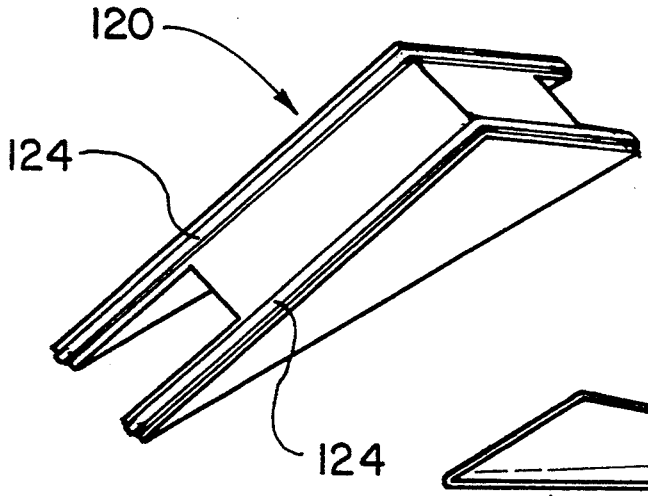
FIG. 9 is a perspective view in elevation of the alternative preferred embodiment of FIG. 8 in accordance with the present invention.
Figure 10:
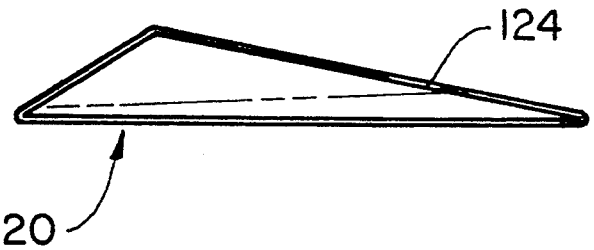
FIG. 10 is a side view of the alternative preferred embodiment of FIGS. 8 and 9 in accordance with the present invention.

An alternative embodiment wedge 120 is shown in FIGS. 8–10. The alternative wedge 120 has slots 122 for holding rubber bands 124 wrapped around the outside of the wedge 120. The rubber bands 124 provide an inexpensive gripping and protecting surface for the wedge 120. When the stile of the window wedges against the alternative wedge 120, the rubber bands 124 will protect the window stile from being damaged by the wedge and will also provide some gripping of the stile by the wedge.

The window wedge of the present invention can be inexpensively manufactured and quickly and easily installed without the need for drilling the window or inserting screws, or otherwise damaging the window. The strips on the window stile can be easily removed if necessary. The wedge can be molded from impact resistant plastics in a variety of colors. The wedge's shape also doubles as a guide for spacing the hook and loop material from the vertical outer edge of the window frame during installation.

It is apparent from the above that the present invention accomplishes all of the objectives set forth by providing a new stop for holding open a window of the type which can slide within a frame made up of: a wedge shaped window stopping means having a first strip of hook and loop fastening material on one side and a second strip of mating hook and loop fastening material which can be fixed to the side of the window frame. The wedge shaped window stopping means can have a recessed slot on one side running from the back of the wedge to the front in which the first strip of hook and loop fastening material can be located. The stopping means can be made of a material selected from the group of plastic, rubber and wood. The wedge shaped window stopping means can have one or more, and preferably two, grooves at least partially running around the circumference of the wedge shaped stopping means such that a rubber band can be positioned within the slot. The hook and loop material can be VELCRO (TM).

With respect to the above description, it should be realized that the optimum dimensional relationships for the parts of the invention, to include variations in size, materials, shape, form, function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as encompass all such modifications and equivalents.

What is claimed as being new and desired to be protected by Letters Patent of the United States is as follows:

1. A stop assembly for holding a window in an open position wherein the window comprises a first member and a second member and said first member is adapted to slide along a linear path relative to and parallel to said second member, said stop assembly comprising:

a wedge member, said wedge member having a base, a first stop surface extending at an angle to said base and a second rear surface extending between said first surface and said base, and means for adjustably fastening said wedge member to said first member along said linear path wherein said first stop surface is adapted to engage said second member in one of a plurality of selectable positions along said linear path;

wherein said wedge member further includes a recess in said base extending longitudinally therein such that said recess intercepts said first stop surface at one end of said base and intercepts said second rear surface at another opposed end of said base, said recess defining a mounting surface therein, and complimentary fastening means being affixed to said mounting surface for engaging said means for adjustably fastening said wedge member to said first member, wherein said means for adjustably fastening comprises a first element of hook and loop fastening material receivable in said recess and said complimentary fastening means comprises a second element of hook and loop fastening material affixed to said mounting surface.

2. The stop assembly of claim 1 wherein said base is rectangularly shaped, said recess is rectangularly shaped, and said first element of hook and loop fastening material comprises a rectangularly shaped strip of material having a longitudinal extent greater than the longitudinal extent of said base.

* * * * *